US007887394B2

(12) United States Patent
Oishi et al.

(10) Patent No.: US 7,887,394 B2
(45) Date of Patent: Feb. 15, 2011

(54) DOUBLE-DISC GRINDING MACHINE, STATIC PRESSURE PAD, AND DOUBLE-DISC GRINDING METHOD USING THE SAME FOR SEMICONDUCTOR WAFER

(75) Inventors: Hiroshi Oishi, Fukushima (JP); Kenji Kobayashi, Fukushima (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 325 days.

(21) Appl. No.: 12/086,029

(22) PCT Filed: Nov. 1, 2006

(86) PCT No.: PCT/JP2006/321845

§ 371 (c)(1),
(2), (4) Date: Jun. 4, 2008

(87) PCT Pub. No.: WO2007/066457

PCT Pub. Date: Jun. 14, 2007

(65) Prior Publication Data

US 2009/0053978 A1 Feb. 26, 2009

(30) Foreign Application Priority Data

Dec. 8, 2005 (JP) ..... 2005-355294

(51) Int. Cl.
*B24B 41/06* (2006.01)

(52) U.S. Cl. ..... 451/63; 451/398

(58) Field of Classification Search ..... 451/57, 451/41, 63, 398, 112, 268, 269
See application file for complete search history.

(56) References Cited

U.S. PATENT DOCUMENTS 6,196,901 B1 * 3/2001 Minami ..... 451/63

(Continued)

FOREIGN PATENT DOCUMENTS

CN 1504315 A 6/2004

(Continued)

OTHER PUBLICATIONS

Chinese Office Action issued in Chinese Application No. 2006800462184; Sep. 30, 2009 (With Partial Translation).

*Primary Examiner*—Robert Rose
(74) *Attorney, Agent, or Firm*—Oliff & Berridge, PLC

(57) ABSTRACT

The present invention is a static pressure pad for supporting both sides of a raw wafer without contact by a static pressure of a fluid supplied to the both sides of the raw wafer in a double-disc grinding machine for a semiconductor wafer, wherein in patterns of lands to be banks of surrounding pockets formed on a surface side of supporting the raw wafer of the static pressure pad, an outer circumferential land pattern required to support the raw wafer is a concentric circle with respect to a rotation center of the raw wafer, and a land pattern inside the outer circumferential land pattern is a non-concentric circle with respect to the rotation center of the raw wafer and asymmetrical with respect to all the straight lines which bisect the static pressure pad. With this static pressure pad, there is provided the double-disc grinding machine and a double-disc grinding method for the semiconductor wafer, which can minimize a "middle ring" of average components obtained by averaging a nanotopography of the wafers after the double-disc grinding.

3 Claims, 9 Drawing Sheets

U.S. PATENT DOCUMENTS

| | | | | |
|---|---|---|---|---|
| 7,150,674 | B2 * | 12/2006 | Okura | 451/8 |
| 2004/0096529 | A1 | 5/2004 | Shih et al. | |
| 2005/0202757 | A1 | 9/2005 | Junge et al. | |
| 2007/0161334 | A1 | 7/2007 | Ohkura | |
| 2010/0144248 | A1 * | 6/2010 | Futamura | 451/57 |

FOREIGN PATENT DOCUMENTS

| | | | |
|---|---|---|---|
| JP | A-11-077498 | | 3/1999 |
| JP | A-2003-124167 | | 4/2003 |
| JP | A-2005-254449 | | 9/2005 |
| WO | WO 00/67950 | A1 | 11/2000 |
| WO | WO 2004/033148 | A1 | 4/2004 |
| WO | WO 2005/070620 | A1 | 8/2005 |

* cited by examiner (a)

(b)

(c)

| LAND PATTERN | NANOTOPOGRAPHY |
|---|---|
| (a)CONCENTRIC CIRCLE PATTERN |   |
| (b)NON-CONCENTRIC CIRCLE PATTERN |   |
| (c)NON-CONCENTRIC CIRCLE AND ASYMMERTICAL PATTERN |   |

(a)

(b)

(a)

(b)

(a)

(b)

DOUBLE-DISC GRINDING MACHINE, STATIC PRESSURE PAD, AND DOUBLE-DISC GRINDING METHOD USING THE SAME FOR SEMICONDUCTOR WAFER

TECHNICAL FIELD

The present invention relates to a double-disc grinding machine and a double-disc grinding method for a semiconductor wafer, and particularly to a static pressure pad which supports both sides of a raw wafer by a static pressure of a fluid supplied to the both sides of the raw wafer, without contact.

BACKGROUND ART

As for semiconductor silicon wafers (hereafter referred to as wafer), the size of a surface waviness component called a "nanotopography" has been a problem in recent years. The nanotopography is a $\lambda$=0.2 to 20 millimeters wavelength component extracted from a surface shape of the wafer, which is shorter than "sori" or "Warp" and longer than "surface roughness", and also a very shallow waviness with a PV value equal to or less than 0.1 to 0.2 micrometer.

The nanotopography is generally measured by an "optical interferometric" measuring instrument (brand name; Nanomapper (ADE Corp.) or Dynasearch (Raytex Corporation)), and a measurement example thereof is shown in FIG. 5. FIG. 5(*a*) is a nanotopography map, where intensity of the nanotopography is qualitatively shown with contrasting density. Meanwhile, FIG. 5(*b*) shows shapes and quantitative intensities of the nanotopography on four sections (diameters) measured for every interval of 45 degrees, and the peak and the valley of the graph respectively correspond to the dark color and the light color of the nanotopography map. Incidentally, FIG. 6 is a schematic view illustrating correspondences between the nanotopography map and nanotopography sectional shapes.

It is said that this nanotopography has an influence on a yield of STI (Shallow Trench Isolation) process in device manufacturing. The nanotopography is built up in a wafer processing process (slice to polish), and strongly influenced by a grinding processing, especially double-disc grinding.

An outline of the double-disc grinding is schematically shown in FIG. 2. A raw wafer W (sliced wafer) is inserted in a hole with substantially the same diameter as the wafer, which is perforated in a glass epoxy thin plate (not shown), and as shown in FIG. 2(*a*), the raw wafer is held so that there may be gaps h between each of static pressure pads 11 and 21 and itself, wherein the static pressure pads are two metal thick plates on the right and left sides of the wafer with substantially the same size as the wafer diameter. The static pressure pad has lands 13 (bank portions) and pockets 14 (concave portions) on the surface as shown in FIG. 4(*a*). Static pressure water is supplied to the pockets 14 and thereby the wafer W is rotatably held as shown in FIG. 2 (*c*). A Part of the static pressure pads are cut out as shown in FIG. 4(*a*) and grinding wheels 12 and 22 are inserted therein to rotate the wafer W and the grinding wheels 12 and 22 as shown in FIG. 2(*b*), so that the wafer W is simultaneously grinded from both the right and left sides. The wafer W rotates at several tens of rpm during grinding by driving it in such a way of pressing a driving roller against an edge or hocking claws into notches, for example. Note that the pattern of the lands 13 of a conventional static pressure pad is a concentric circle with respect to a rotation center of the wafer (it corresponds with a center of the pad) as shown in FIG. 4(*a*).

For the wafer, which has been ground by the double-disc grinding, the nanotopography is measured with Nanomapper or the like as described above. The resulting data is processed with an operational program, and nanotopography measurement values on four diameters of the wafer surface, that is, the nanotopography measurement values on eight radii thereof are then obtained (FIG. 7 (*a*)). The obtained nanotopography measurement values on the eight radii are averaged by eight point at each position in a radial direction, and an "average component" shown in FIG. 7(*b*) is then obtained (refer to FIG. 10 for the positions in the radial direction).

As for the average component, it is known that it can be classified into a double-disc center, a central concave-convex portion, a middle ring, an outermost circumferential ring, or the like according to a distance from the wafer center as shown in FIG. 7(*b*).

Conventionally, warpage may occur on the wafer ground by unbalanced cutting loads on both sides of the wafer or the like during the double-disc grinding, so that in order to suppress the occurrence of the warpage, a double-disc grinding method wherein a relative position between the wafer and the grinding wheels is adjusted has been proposed (for example, refer to International Patent Application Publication 00/67950). A specific example of such a method for adjusting positions of the wafer W and the grinding wheels 12 and 22 is shown in FIG. 8. One is called "shift adjustment", wherein the grinding wheels 12 and 22 are vertically moved in parallel to the wafer surface (FIG. 8(*a*)), and the other is called "tilt adjustment", wherein relative angles between the wafer surface and each of the grinding wheels 12 and 22 are changed (FIG. 8(*b*)).

Ten examples of the average components with the different adjusted amounts obtained by performing such shift adjustment and tilt adjustment on the double-disc grinding machine, measuring the nanotopography of the wafer ground with the adjusted double-disc grinding machine, and processing the nanotopography measurement values are shown in FIG. 9, where they are overlappingly drawn. It is understood from FIG. 9 that the "central concave-convex portion" and the "outermost circumferential ring" can be changed in direction and size in +/− directions by the shift adjustment or the tilt adjustment and an improvement can be achieved, while the "middle ring" is hardly changed in direction and size. As described above, although the "central concave-convex portion" and the "outermost circumferential ring" of the average components in the nanotopography could be minimized only by the conventional shift adjustment or tilt adjustment, the "middle ring" thereof could not be minimized only by it.

DISCLOSURE OF THE INVENTION

Problem to be Solved by the Invention

The present invention is made in view of such problems, and an object of the present invention is to provide a double-disc grinding machine and a double-disc grinding method for semiconductor wafers, which can minimize a "middle ring" of average components obtained by averaging a nanotopography of a wafer after double-disc grind.

Means for Solving Problem

The present invention is made to solve the above described problems, and provides a static pressure pad for supporting both sides of a raw wafer without contact by a static pressure of a fluid supplied to the both sides of the raw wafer in the double-disc grinding machine for the semiconductor wafer, wherein in patterns of lands to be banks of surrounding pockets formed on a surface side of supporting the raw wafer of the static pressure pad, an outer circumferential land pattern required to support the raw wafer is a concentric circle with respect to a rotation center of the raw wafer, and a land pattern inside the outer circumferential land pattern is a non-concentric circle with respect to the rotation center of the raw wafer and asymmetrical with respect to all the straight lines which bisect the static pressure pad.

As described above, given the static pressure pad wherein the outer circumferential land pattern required to support the raw wafer is a concentric circle with respect to the rotation center of the raw wafer, and the land pattern inside the outer circumferential land pattern is a non-concentric circle with respect to the rotation center of the raw wafer and asymmetrical with respect to all the straight lines which bisect the static pressure pad, the "middle ring" of the average components obtained by averaging the nanotopography of the wafer after double-disc grind can be minimized, allowing the yield in a device manufacturing process to be improved.

In addition, the present invention provides a double-disc grinding machine comprising the above described static pressure pad, wherein the double-disc grinding machine at least supports a raw wafer by a static pressure of a fluid and grinds both sides of the raw wafer simultaneously.

As is understood, given the double-disc grinding machine including the above described static pressure pad, it will result in the double-disc grinding machine in which the "middle ring" of the average components obtained by averaging the nanotopography of the wafer after the double-disc grind can be minimized to thereby allow the yield in the device manufacturing process to be improved.

Furthermore, the present invention provides a double-disc grinding method for a semiconductor wafer, wherein a fluid is supplied to both sides of a raw wafer, and the raw wafer is subjected to double-disc grinding while the both sides of the raw wafer are supported without contact with the static pressure pad by a static pressure obtained from the supplied fluid.

As is understood, if the wafer is subjected to the double-disc grinding using the above described static pressure pad, the "middle ring" of the average components obtained by averaging the nanotopography of the wafer after the double-disc grind can be minimized to thereby allow the yield in the device manufacturing process to be improved.

EFFECT OF THE INVENTION

As described above, the present invention provides the static pressure pad wherein the outer circumferential land pattern required to support the raw wafer is a concentric circle with respect to the rotation center of the raw wafer, and the land pattern inside the outer circumferential land pattern is a non-concentric circle with respect to the rotation center of the raw wafer and also asymmetrical with respect to all the straight lines which bisect the static pressure pad. Performing the double-disc grinding on the wafer using this static pressure pad makes it possible to minimize the "middle ring" of the average components obtained by averaging the nanotopography of the double-disc ground wafer and to manufacture the wafers with good nanotopography. As a result, an improvement in yield in the device manufacturing process using the wafers can be achieved.

BEST MODE(S) FOR CARRYING OUT THE INVENTION

Hereafter, the present invention will be described in more detail, but it is not limited thereto.

Figure 9:
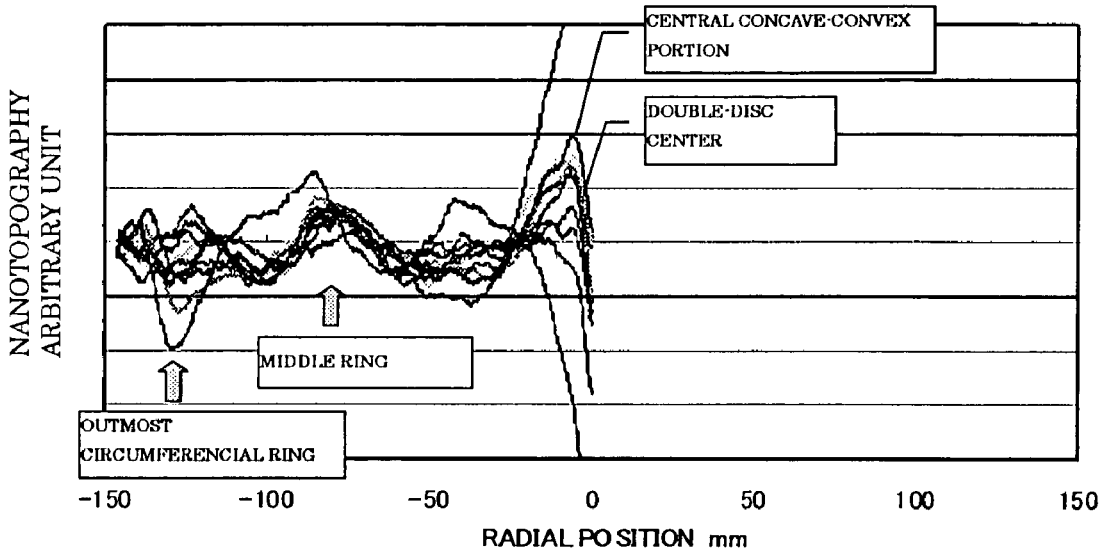
FIG. 9 is a graph wherein ten examples of average components are drawn together, the average components being obtained by averaging the nanotopography of the wafers for which the shift adjustment and the tilt adjustment have been performed and then double-disc grinding performed.
Figure 10:
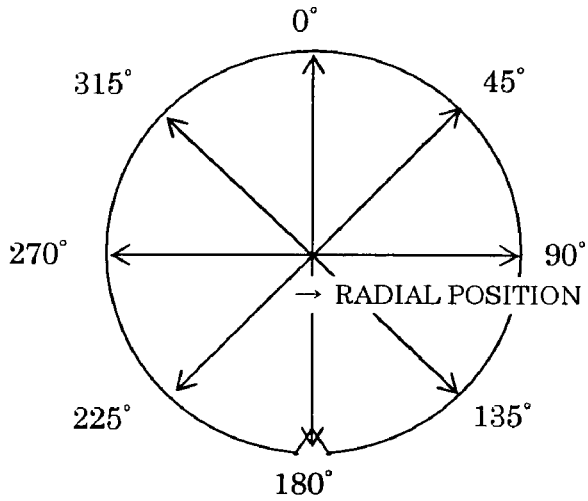
FIG. 10 is a schematic view showing positions in a radial direction when nanotopography measurement values on eight radii of a wafer surface are used.

As described above, although the direction and the size of the "central concave-convex portion" or the "outermost circumferential ring" of the average components obtained by averaging the nanotopography of the wafer after the double-disc grind can be changed and minimized by the shift adjustment and the tilt adjustment, those of the "middle ring" cannot be changed (refer to FIG. 9). Consequently, after the inventors consider that generation mechanism of the "middle ring" is different from that of the "central concave-convex portion" or the "outermost circumferential ring", and as a result of earnest examination, it has been found that the land pattern of the static pressure pad and the "middle ring" of the nanotopography correspond to each other, and that the "middle ring" can be minimized by changing the land pattern of the static pressure pad from the conventional concentric circle pattern to the non-concentric circle pattern and also to an asymmetrical pattern with respect to all the straight lines which bisect the static pressure pad, thus achieving the present invention.

Specifically, a static pressure pad according to the present invention is a static pressure pad for supporting both sides of a raw wafer without contact by a static pressure of a fluid supplied to the both sides of the raw wafer, in a double-disc grinding machine for a semiconductor wafer, wherein in patterns of lands to be banks of surrounding pockets formed on a surface side of supporting the raw wafer of the static pressure pad, an outer circumferential land pattern required to support the raw wafer is a concentric circle with respect to a rotation center of the raw wafer, and a land pattern inside the outer circumferential land pattern is a non-concentric circle with respect to the rotation center of the raw wafer and asymmetrical with respect to all the straight lines which bisect the static pressure pad.

As described above, the static pressure pad according to the present invention is characterized in that the outer circumferential land pattern is a concentric circle with respect to the rotation center of the wafer, and the land pattern inside the outer circumferential land pattern is a non-concentric circle with respect to the rotation center of the raw wafer and asymmetrical with respect to all the straight lines which bisect the static pressure pad.

Figure 4:
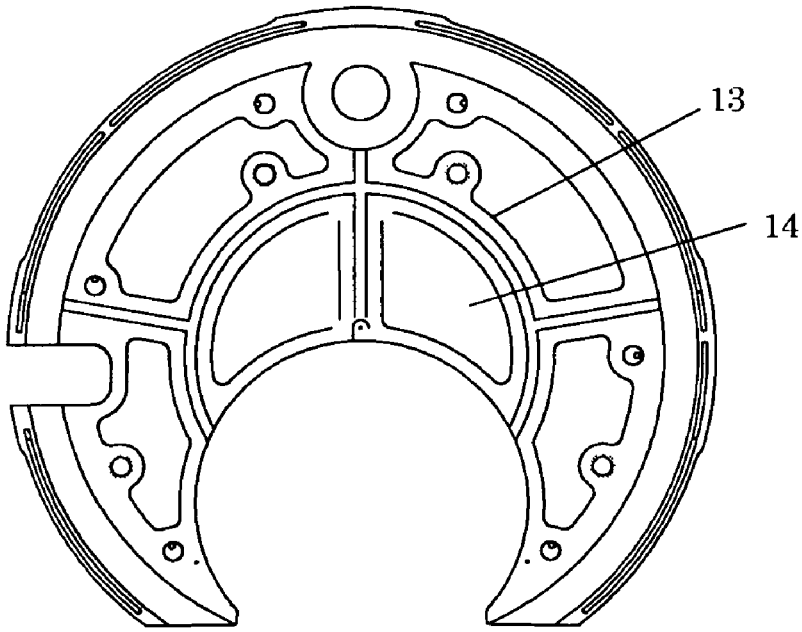
FIG. 4(*a*) is an example of the conventional static pressure pad and FIG. 4(*b*) is another thereof.
Figure 4:
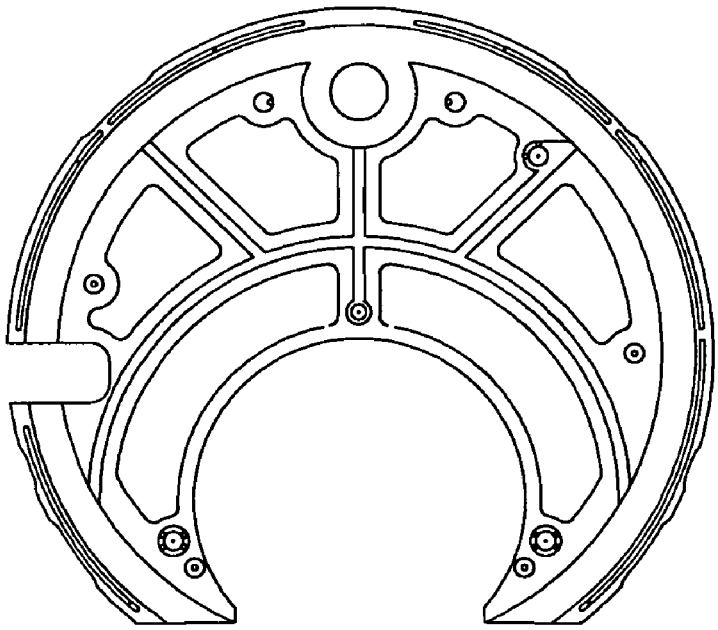
Figure 5:
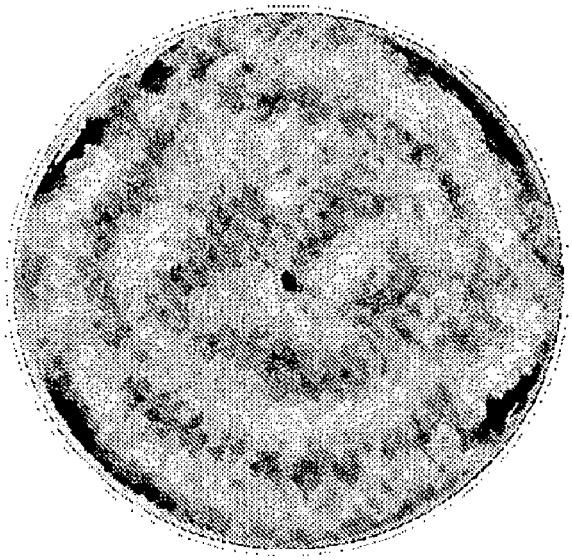
FIG. 5(*a*) is a nanotopography map qualitatively showing intensity of a nanotopography with contrasting density and FIG. 5(*b*) is a graph showing shapes and the quantitative intensity of the nanotopography on 4 sections (diameter) measured at intervals of 45 degrees.
Figure 5:
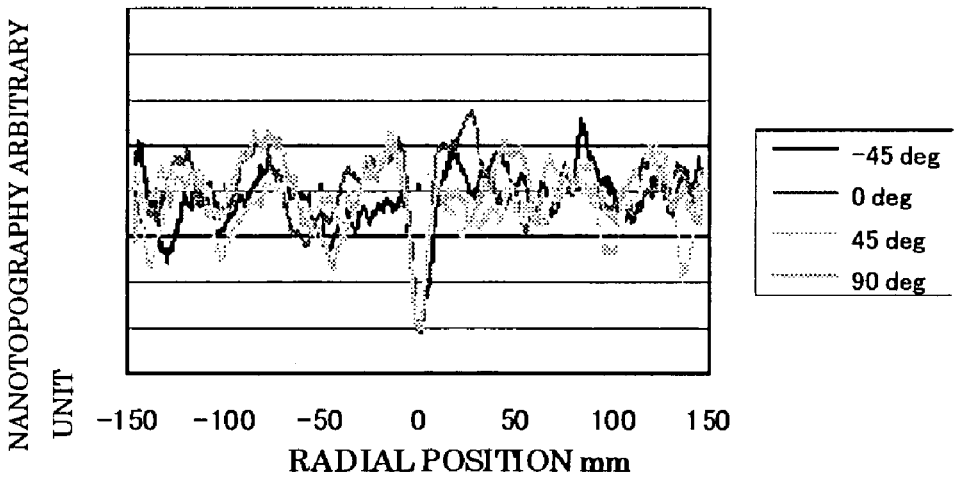
Figure 6:
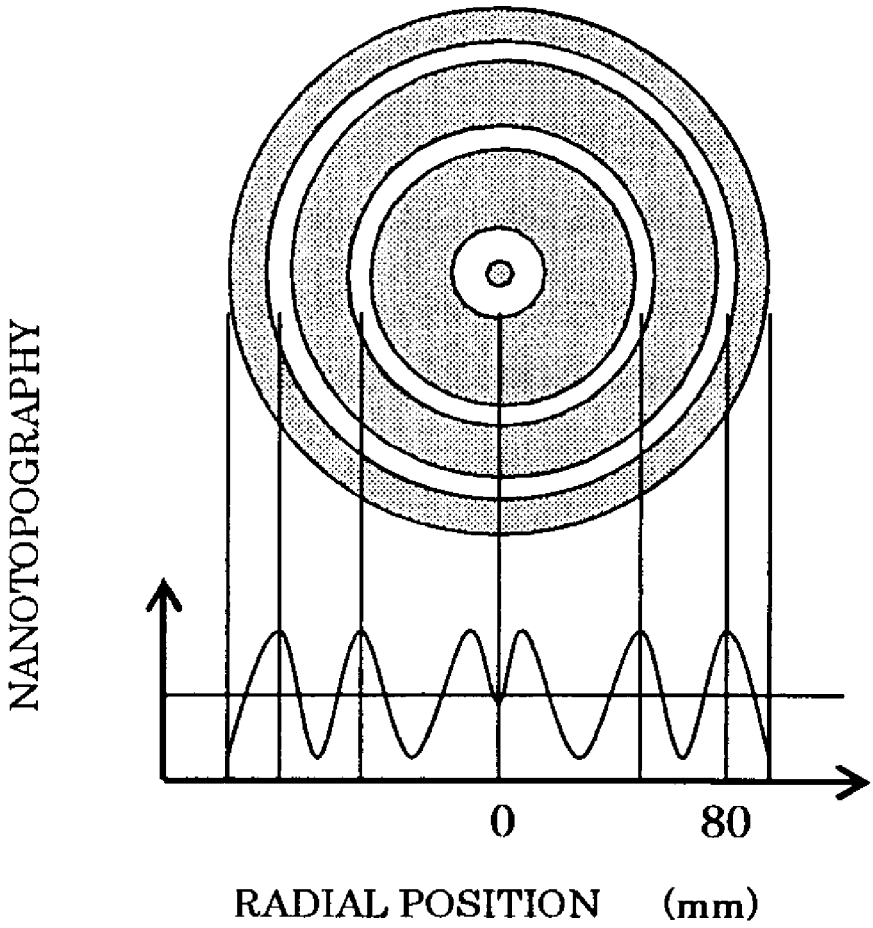
FIG. 6 is a schematic view illustrating a correspondence between a nanotopography map and nanotopography sectional shapes.

The outer circumferential land pattern required to support the raw wafer is required to be a concentric circle with respect to the rotation center of the raw wafer. Conventionally, the other patterns have also been the same concentric circle patterns as shown in FIG. 4(*a*). However, that pattern will generate the "middle ring" in the nanotopography corresponding to the land patterns as described above. Consequently, in the present invention, the land pattern inside the outer circumferential land pattern is prevented from being a concentric circle with respect to the rotation center of the wafer (center of the pad), and all the straight lines which bisect the static pressure pad are formed so as to be asymmetrical, thereby allowing the double-disc grinding for the wafers to be performed more uniformly.

Figure 1:
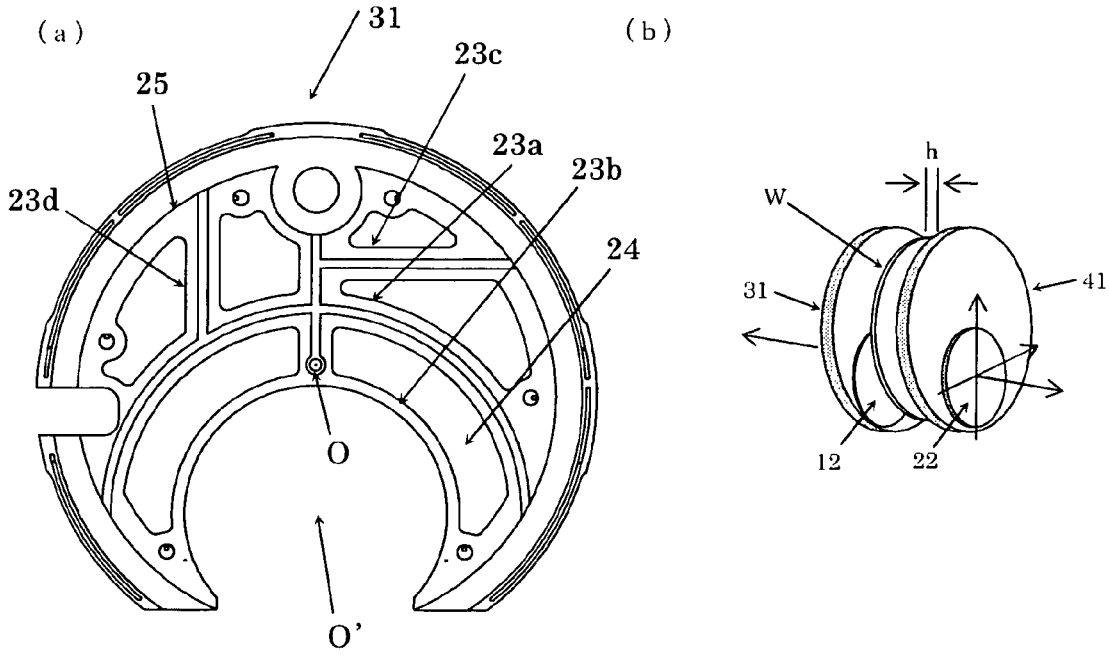
FIG. 1(*a*) is an example of a static pressure pad according to the present invention, and FIG. 1(*b*) is a schematic view of a double-disc grinding machine according to the present invention.

Such land patterns of the static pressure pad are not particularly limited, but land patterns shown in FIG. 1(*a*) may be included, for example. As shown in FIG. 1(*a*), a static pressure pad 31 according to the present invention has lands 23*a*, 23*b*, 23*c*, 23*d*, and 25 (bank portions) and pockets 24 (concave portions). Assuming the center of the pad is O, a pattern of the land 25 of the outer circumference which is required to support the raw wafer is a concentric circle with respect to a rotation center O of the wafer (it corresponds with the center of the pad). Meanwhile, the patterns of the lands 23*a*, 23*b*, and the like inside the outer circumferential land pattern are non-concentric circles with respect to the rotation center O of the wafer and semicircular pattern with the same center as a hole into which a grinding wheel is inserted. Moreover, the patterns of the lands 23*c*, 23*d*, and the like inside the outer circumferential land pattern are asymmetrical with respect to all the straight lines which bisect the static pressure pad, and specifically, when a straight line which connects the rotation center O of the wafer and a center O' of the hole into which the grinding wheel is inserted is set as a symmetric axis, the patterns are asymmetrical at the right and left of the axis.

Note that the pattern of the land inside the outer circumferential land pattern is not limited to the one shown in FIG. 1(*a*), but may be just small in the degree of point symmetry with respect to the rotation center O of the wafer.

Additionally, the static pressure pad according to the present invention is preferably circular as shown in FIG. 1 (*a*). Thus, since the static pressure pad is circular, the raw wafer can be more certainly supported as compared with the case where it is a semicircular or fan-shaped pad with small area.

Moreover, the present invention provides a double-disc grinding machine for a semiconductor wafer comprising the above described static pressure pad, which at least supports the raw wafer by the static pressure of the fluid and grinds both sides of the raw wafer simultaneously.

The double-disc grinding machine including the above described static pressure pad will be specifically described with reference to FIG. 1(*b*). The double-disc grinding machine according to the present invention includes the static pressure pads 31 and 41 according to the present invention described above. As described above, the pads shown in FIG. 1(*a*) may be included as an embodiment of the static pressure pads 31 and 41 according to the present invention, for example. The static pressure pad has the lands 23 (bank portions) and the pockets 24 (concave portions) on the surface as shown in FIG. 1(*a*), and the wafer W can be rotatably held without contact by the static pressure of the fluid supplied to the pockets 24. A part of the static pressure pads 31 and 41 is cut out and grinding wheels 12 and 22 are inserted therein to rotate the wafer W and the grinding wheels 12 and 22, so that the wafer W can be simultaneously grinded from both the right and left sides.

If the double-disc grinding is performed using the static pressure pad according to the present invention or a double-disc grinding machine including the same, since, in the patterns of the lands of the static pressure pad, the outer circumferential land pattern required to support the raw wafer is a concentric circle with respect to the rotation center of the raw wafer, and the land pattern inside the outer circumferential land pattern is a non-concentric circle with respect to the rotation center of the raw wafer and asymmetrical with respect to all the straight lines which bisect the static pressure pad, the "middle ring" of the average components obtained by averaging the nanotopography of the wafer after the double-disc grind can be minimized, allowing the yield in the device manufacturing process to be improved.

In addition, the present invention provides a double-disc grinding method for the semiconductor wafer, being characterized in that double-disc grinding for the raw wafer is performed while supporting the both sides of the raw wafer without contact with the above described static pressure pad by the static pressure of the fluid supplied to the both sides of the raw wafer.

The double-disc grinding method described above will be specifically described with reference to FIG. 1(*b*). A raw wafer W (sliced wafer) is inserted into a hole with substantially the same diameter as the wafer, which is perforated in a glass epoxy thin plate (not shown), and the raw wafer is held so that there may be a gap h between each of the static pressure pads 31 and 41 and itself, the static pressure pads being two metal thick plates on the right and left sides of the wafer with substantially the same size of the wafer diameter according to the present invention. The static pressure pad used herein has the land patterns described above, and the pads shown in FIG. 1(*a*) may be included as an embodiment, for example. The static pressure pad has the lands 23 (bank portions) and the pockets 24 (concave portions) on the surface as shown in FIG. 1 (*a*). The fluid is supplied to the pockets 24 and the wafer W is rotatably held without contact by a static pressure of the fluid. A part of the static pressure pads is cut out as shown in FIG. 1(*a*), and the grinding wheels 12 and 22 are inserted therein to rotate the wafer W and the grinding wheels 12 and 22, so that the wafer W is simultaneously grinded from both the right and left sides. The wafer W rotates at several tens of rpm during grinding by driving it in such a way of pressing a driving roller against an edge or hocking claws into notches, for example.

The nanotopography of the wafer ground by such double-disc grinding method is measured with an optical interferometric measuring instrument such as Nanomapper. The resulting data is processed with an operational program, and nanotopography measurement values on four diameters of a wafer surface, that is, the nanotopography measurement values on eight radii thereof are then obtained. The obtained nanotopography measurement values on the eight radii are averaged by eight points at each position in a radial direction, and an "average component" is then obtained.

Figure 7:
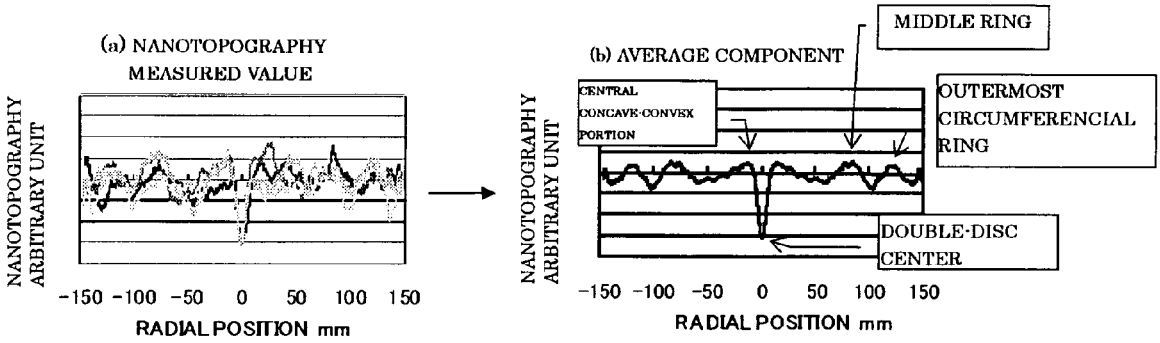
FIG. 7 is a graph showing average components obtained using nanotopography measurement values.
Figure 8:
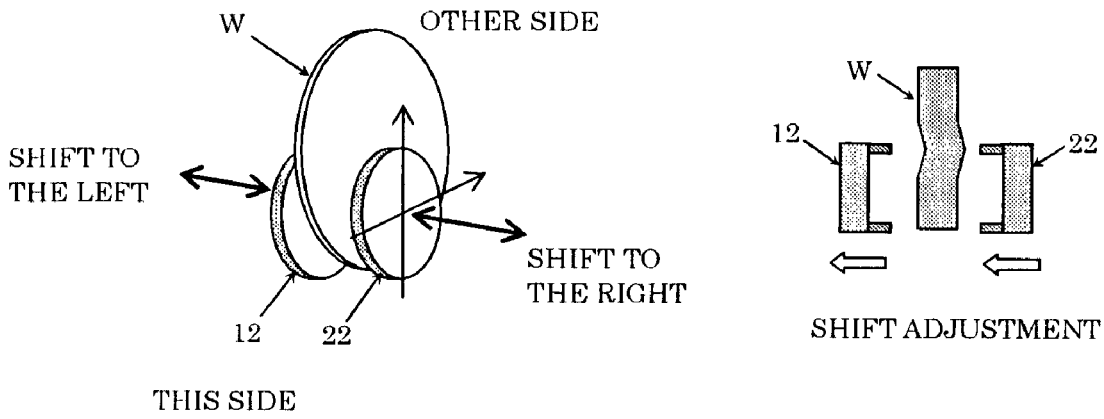
FIG. 8(*a*) is a schematic view illustrating shift adjustment and FIG. 8(*b*) is a schematic view illustrating tilt adjustment.
Figure 8:
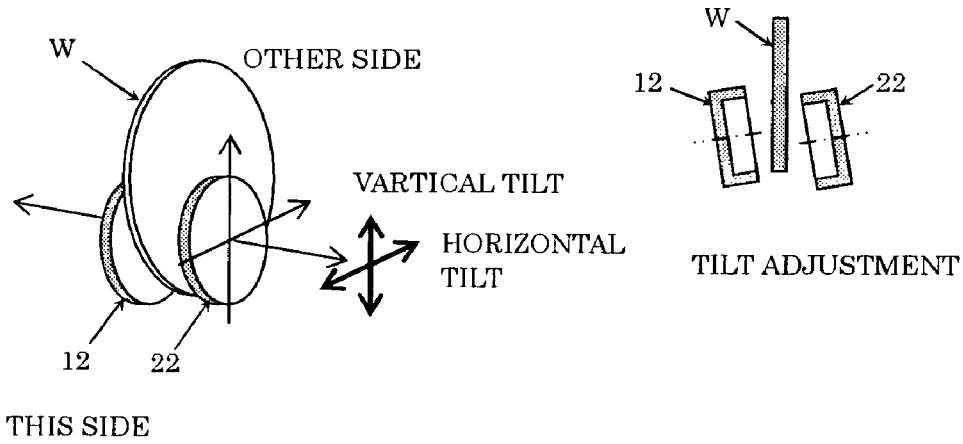

Conventionally, the average components can be classified into a double-disc center, a central concave-convex portion, a middle ring, an outermost circumferential ring, or the like according to the distance from the wafer center as shown in FIG. 7(*b*). Although it has been found that the central concave-convex portion and the outermost circumferential ring can be minimized by adjusting the grinding wheels, which grind the wafer, the middle ring cannot be improved by the adjustment of the grinding wheels, as described above.

Figure 3:
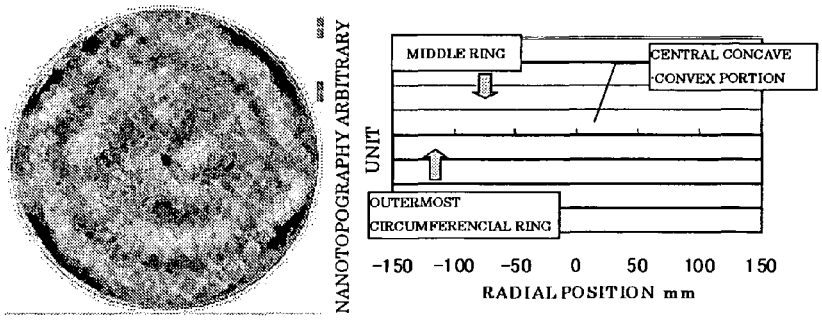
FIGS. 3(*a*) and (*b*) are nanotopography maps and measured values of a double-disc ground wafer using a conventional static pressure pad, and FIG. 3(*c*) is a nanotopography map and measured values of a double-disc ground wafer using the static pressure pad according to the present invention.
Figure 3:
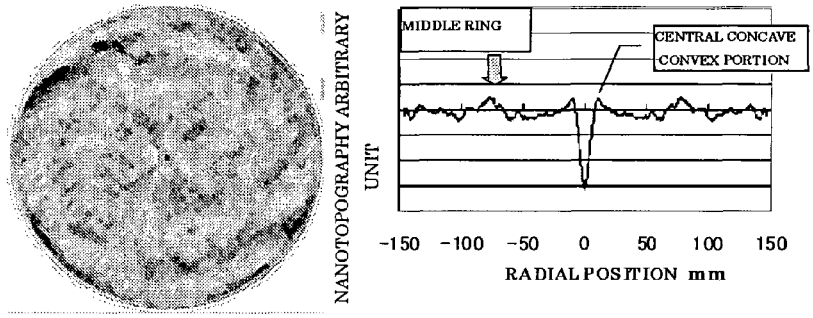
Figure 3:
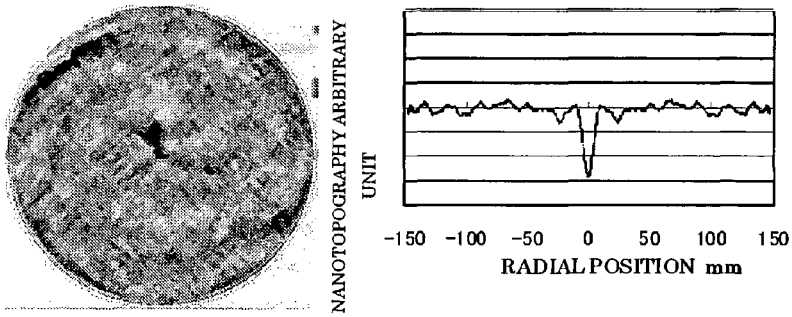

However, performing the double-disc grinding using the double-disc grinding method according to the present invention would make it possible to minimize the "middle ring" of the average components obtained by averaging the nanotopography of the wafer after the double-disc grind as shown, for example, in FIG. 3(*c*), allowing the yield in the device manufacturing process to be improved.

Hereinafter, the present invention will be specifically described while providing embodiments, but the present invention is not limited thereto.

First Comparative Example

A single crystal silicon wafer with a diameter of 300 millimeters manufactured with the CZ method (Czochralski method) was used, as a sample wafer.

Figure 2:
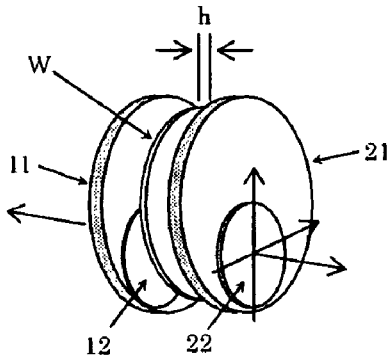
FIG. 2(*a*) is a schematic view of a conventional double-disc grinding, FIG. 2(*b*) is a schematic view showing rotational directions of a wafer and grinding wheels, and FIG. 2(*c*) is a schematic view showing positions of the static pressure pad and the wafer.
Figure 2:
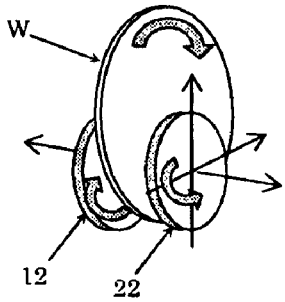
Figure 2:
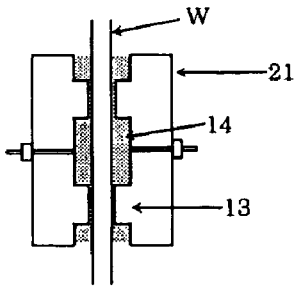

In the double-disc grinding machine used in a double-disc grinding process for semiconductor wafer manufacturing, the conventional static pressure pads (concentric circle pattern) wherein the land pattern in FIG. 4(*a*) is a concentric circle with respect to the rotation center of the wafer are used, and the double-disc grinding was performed on two wafers while supporting the both sides of the raw wafer without contact with the static pressure pads as shown in FIG. 2(*a*).

The nanotopography of the wafer after the double-disc grind was measured with optical measuring instrument Nanomapper. The obtained nanotopography data was processed with the operational program and nanotopography measurement values on the four diameters of the wafer surface, that is, the nanotopography measurement values on the eight radii thereof were obtained. The obtained nanotopography measurement values on the eight radii were averaged by eight points at each position in the radial direction, and the "average component" shown in FIG. 3(*a*) was obtained. The "middle ring", the "central concave-convex portion", and the "outermost circumferential ring" have been confirmed in FIG. 3(*a*).

Second Comparative Example

Based on PV values of the "central concave-convex portion" and the "outermost circumferential ring" obtained above, the shift adjustment and the tilt adjustment for the grinding wheels of the double-disc grinding machine were performed so as to minimize these values.

Furthermore, double-disc grinding was performed on two wafers under the same conditions as that of a first comparative example, except that the static pressure pad (non-concentric circle pattern shown in FIG. 4(*b*)) is used, in which the outer circumferential land pattern required to support the wafer is a concentric circle with respect to the rotation center of the wafer, and the land pattern inside the outer circumferential land pattern is a non-concentric circle with respect to the rotation center of the wafer.

The nanotopography of the wafer after the double-disc grind was measured with optical measuring instrument Nanomapper, and the nanotopography measurement values on the four diameters of the wafer surface were then averaged to obtain average components as well as the first comparative example. The obtained average components are shown in FIG. 3(*b*). It is seen from FIG. 3(*b*) that the "middle ring" and the "central concave-convex portion" remain, while the "outermost circumferential ring" of the average components is minimized.

As described above, it is understood that the "middle ring" cannot be minimized only by changing the land pattern of the static pressure pad into the non-concentric circle one.

First Embodiment

Double-disc grinding was performed on two wafers under the same conditions as that of a second comparative example, except that the static pressure pad (non-concentric circle and asymmetrical pattern shown in FIG. 1(*a*)) was used, in which the outer circumferential land pattern required to support the wafer is a concentric circle with respect to the rotation center of the wafer, and the land pattern inside the outer circumferential land pattern is a non-concentric circle with respect to the rotation center of the wafer and asymmetrical with respect to all the straight lines which bisect the static pressure pad.

The nanotopography of the wafer after the double-disc grind was measured with optical measuring instrument Nanomapper, and the nanotopography measurement values on the four diameters of the wafer surface were then averaged to obtain average components as well as the first comparative example. The obtained average components are shown in FIG. 3(*c*). It is seen from FIG. 3(*c*) that the "middle ring", the "central concave-convex portion", and the "outermost circumferential ring" of the average components are minimized, and the nanotopography is improved as compared with FIG. 3(*a*).

As a result of this, it has been confirmed that the "middle ring" and the "central concave-convex portion" can be minimized to thereby improve the nanotopography by changing the land pattern of the static pressure pad to the non-concentric circle pattern and also to asymmetrical pattern.

Moreover, it has been found that when the land pattern of the static pressure pad is changed from the conventional concentric circle pattern into the non-concentric circle one and further into the non-concentric circle and also asymmetrical one, effect of reducing the "middle ring" in the nanotopography is further improved. This means that the smaller the degree of the point symmetry of the land pattern with respect to the rotation center of the wafer becomes, the more improved the intensity of the middle ring.

Incidentally, the present invention is not limited to the above embodiments. The above described embodiments are just examples, and those having substantially the same constitution as technical ideas described in the claims of the present invention, and providing similar functions and advantages are included in the technical scope of the present invention.

For example, the measurement of the nanotopography may be performed by a capacitance measuring instrument or a laser sensor in addition to the optical interferometric measuring instrument. Moreover, the wafers manufactured according to the present invention are not limited to semiconductor silicon wafers, but may be compound semiconductor wafers.

The invention claimed is:

1. A static pressure pad for supporting both sides of a raw wafer without contact by a static pressure of a fluid supplied to the both sides of the raw wafer in a double-disc grinding machine for a semiconductor wafer, wherein in patterns of lands to be banks surrounding a plurality of pockets formed on a surface side supporting the raw wafer of the static pressure pad, an outer circumferential land pattern required to support the raw wafer is a concentric circle with respect to a rotation center of the raw wafer, a land pattern inside the outer circumferential land pattern is a non-concentric circle with respect to the rotation center of the raw wafer and a land pattern made up of a portion interposed between the plurality of pockets among the land pattern inside the outer circumferential land pattern is asymmetrical with respect to all the straight lines which bisect the static pressure pad.

2. A double-disc grinding machine comprising the static pressure pad according to claim 1, wherein the double-disc grinding machine at least supports a raw wafer by a static pressure of a fluid and grinds both sides of the raw wafer simultaneously.

3. A double-disc grinding method for semiconductor wafers, wherein a fluid is supplied to both sides of a raw wafer, and the raw wafer is subjected to double-disc grinding while the both sides of the raw wafer are supported without contact with the static pressure pad according to claim 1 by a static pressure obtained from the supplied fluid.

* * * * *